US010147528B2

(12) United States Patent
Zhang et al.

(10) Patent No.: US 10,147,528 B2
(45) Date of Patent: Dec. 4, 2018

(54) NON-ORIENTED ELECTRICAL STEEL SHEET WITH FINE MAGNETIC PERFORMANCE, AND CALCIUM TREATMENT METHOD THEREFOR

(75) Inventors: Feng Zhang, Shanghai (CN); Xiandong Liu, Shanghai (CN); Shishu Xie, Shanghai (CN); Xuejun Lu, Shanghai (CN); Xiao Chen, Shanghai (CN); Aihua Ma, Shanghai (CN); Peili Zhang, Shanghai (CN); Yanwei Wang, Shanghai (CN); Lan Zhang, Shanghai (CN); Hongxu Hei, Shanghai (CN)

(73) Assignee: Boashan Iron & Steel Co., LTD, Shanghai (CN)

( * ) Notice: Subject to any disclaimer, the term of this patent is extended or adjusted under 35 U.S.C. 154(b) by 575 days.

(21) Appl. No.: 14/379,529

(22) PCT Filed: Mar. 27, 2012

(86) PCT No.: PCT/CN2012/000385
§ 371 (c)(1),
(2), (4) Date: Aug. 19, 2014

(87) PCT Pub. No.: WO2013/131213
PCT Pub. Date: Sep. 12, 2013

(65) Prior Publication Data
US 2015/0034212 A1 Feb. 5, 2015

(30) Foreign Application Priority Data
Mar. 8, 2012 (CN) ..... 2012 1 0060172

(51) Int. Cl.
*H01F 1/147* (2006.01)
*C21C 7/10* (2006.01)
(Continued)

(52) U.S. Cl.
CPC ..... *H01F 1/14775* (2013.01); *C21C 7/0006* (2013.01); *C21C 7/06* (2013.01);
(Continued)

(58) Field of Classification Search
CPC ..... C21C 7/00; C21C 7/0006; C21C 7/06; C21C 7/08; C21C 7/10; C21D 8/00;
(Continued)

(56) References Cited

U.S. PATENT DOCUMENTS 4,294,611 A * 10/1981 Tamas ..... C21C 7/06 75/508
4,956,009 A * 9/1990 Robison, Jr. ..... C21C 7/0645 420/129
(Continued)

FOREIGN PATENT DOCUMENTS

| | | |
|---|---|---|
| CN | 101768653 A | 7/2010 |
| CN | 102134630 A | 7/2011 |
| JP | 2000-73116 A | 3/2000 |

OTHER PUBLICATIONS

Espacenet Machine Translation of CN 101768653 A.*
(Continued)

*Primary Examiner* — Kaj K Olsen
*Assistant Examiner* — Alexandra M Moore
(74) *Attorney, Agent, or Firm* — Eversheds Sutherland (US) LLP

(57) ABSTRACT

A non-oriented electrical steel sheet with fine magnetic performance, and a calcium treatment method therefor, including an RH (Ruhrstahl-Heraeus) refinement step. The RH refinement step sequentially comprises a decarbonization step, an aluminum deoxidation step, and a step of adding calcium alloy. In the step of adding calcium alloy, time when the calcium alloy is added satisfies the following condition: time interval between Al and Ca/total time after
(Continued)

ΣAl=0.2-0.8. In this method, production cost is reduced, the production process is simple, a normal processing cycle of RH refinement is not affected, the device is convenient in operation and is controllable, and foreign substances are controllable in both shape and quantities. The non-oriented electrical steel sheet prepared according to the present invention has fine magnetic performance, and the method can be used for mass production of the non-oriented electrical steel sheet with fine magnetic performance.

18 Claims, 2 Drawing Sheets

(51) Int. Cl.

| | |
|---|---|
| ***C22C 38/06*** | (2006.01) |
| ***C22C 38/00*** | (2006.01) |
| ***C22C 38/02*** | (2006.01) |
| ***C22C 38/04*** | (2006.01) |
| ***C21D 8/12*** | (2006.01) |
| ***C21D 9/46*** | (2006.01) |
| ***C21C 7/06*** | (2006.01) |
| ***H01F 1/16*** | (2006.01) |
| ***C21C 7/00*** | (2006.01) |
| ***C21C 7/068*** | (2006.01) |

(52) U.S. Cl.
CPC ..... *C21C 7/068* (2013.01); *C21C 7/10* (2013.01); *C21D 8/12* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *H01F 1/14766* (2013.01); *H01F 1/16* (2013.01); *H01F 1/14791* (2013.01)

(58) Field of Classification Search
CPC .... C21D 8/12; C21D 9/00; C21D 9/46; C22C 38/00; C22C 38/001; C22C 38/002; C22C 38/004; C22C 38/02; C22C 38/04; C22C 38/06; H01F 1/14766; H01F 1/16; H01F 1/14791; H01F 1/00
See application file for complete search history.

(56) References Cited

U.S. PATENT DOCUMENTS

| | | | | |
|---|---|---|---|---|
| 5,017,246 | A * | 5/1991 | Miyasaka | C22C 38/38 148/325 |
| 5,055,018 | A * | 10/1991 | Ototani | C21C 7/0006 420/8 |
| 5,268,141 | A * | 12/1993 | Ototani | C04B 35/057 420/103 |
| 5,555,916 | A * | 9/1996 | Kushida | C22C 38/60 138/140 |
| 6,120,578 | A * | 9/2000 | Nakato | C21C 7/06 148/625 |
| 6,478,892 | B2 | 11/2002 | Murakami et al. | |
| 6,685,763 | B1 * | 2/2004 | Bertrand | B22D 11/11 75/568 |
| 2009/0202383 | A1 * | 8/2009 | Tanaka | C22C 38/004 420/83 |
| 2010/0071509 | A1 * | 3/2010 | Numata | C21C 7/0075 75/560 |

OTHER PUBLICATIONS

PCT International Search Report for PCT Application No. PCT/CN2012/000385 dated Dec. 13, 2012 (6 pages).
Feng et al., "Effect of Calcium Treatment on Non-Metallic Inclusions in Non-Oriented Silicon Steel," Special Steel, 2011, 32(1):44-47.

* cited by examiner

Ordinary furnace number

Furnace number of the present invention

NON-ORIENTED ELECTRICAL STEEL SHEET WITH FINE MAGNETIC PERFORMANCE, AND CALCIUM TREATMENT METHOD THEREFOR

CROSS REFERENCE TO RELATED APPLICATIONS

This application claims the priority benefit of PCT/CN2012/000385 filed on Mar. 27, 2012 and Chinese Application No. 201210060172.9 filed on Mar. 8, 2012. The contents of these applications are hereby incorporated by reference in their entirety.

FIELD OF INVENTION

The present invention relates to a non-oriented electrical steel sheet and its manufacturing method, and specifically a non-oriented electrical steel sheet with excellent magnetic property and its calcium treatment method.

BACKGROUND OF THE INVENTION

The process of adding calcium into liquid steel to modify oxide and sulfide inclusions and thus improve steel quality has been generally accepted by persons in metallurgical field. At present, the technique has been widely used in pipeline steel, gear steel, weathering-resistant steel, free-cutting steel stainless steel, electrical steel and other high-end products, so as to improve the corrosion resistance, microstructure, mechanical property, manufacturability, and electromagnetic performance, etc.

Calcium does not dissolve in liquid steel, and has a low melting point (850° C.) and a low boiling point (1,483° C.). And it is easy to form calcium steam which exists in the form of bubbles inside liquid steel. Calcium also has a strong deoxidizing and desulfurizing capacity, and may react with the oxygen and sulfur in liquid steel to form complex sulfides, calcium aluminates and other inclusions. On one hand, it is easy for these calcium oxide-enriched particles formed during deoxidation to separate from the melting pool; on the other hand, when the melting pool is stirred, the solid calcium oxide inclusions in liquid steel may be modified so as to reduce the melting point of the inclusions, facilitate their polymerization, growth and floating upward, and improve the purity of steel.

Generally, calcium treatment is conducted in the atmospheric status to avoid the excessive loss of calcium. Such calcium treatment methods include wire feeding method (CaFe, CaSi), blowing method (CaSi, CaO) and shooting method (CaFe, CaSi). At present, these techniques are relatively mature and easy to operate, which play an important role in industrial production. However, applying these techniques usually increase the smelting treatment cycle, lead to significant temperature drop in the treatment process and cause secondary pollution problems (like oxygen uptake, nitrogen uptake, entrapped slag, etc.) due to the boiling of liquid steel, which are unfavorable for the stable improvement of steel purity and production efficiency.

Among these techniques, the relatively representative calcium treatment methods include the following methods:

In the Japanese laid-open Patent Publication No. 1996-157932, in the atmospheric status, liquid steel is added with calcic materials after deoxidation by the input method. The patent points out that the addition amount of calcic materials depends on the content of silicon oxide in the slag. Appropriate calcium treatment can improve the steel quality defect of finished strip steel products caused by the large amount of inclusions.

In the Japanese laid-open Patent Publication No. 2009-57612, in the atmospheric status, liquid steel is added with CaSi wire by the wire feeding method, wherein the yield of calcium can reach as high as 6.7% at a wire feeding rate of 100 m/min. However, at the end of wire feeding, the violent boiling of liquid steel may cause relatively significant secondary pollution.

In order to prevent the increase of oxygen and nitrogen of liquid steel caused by the calcium treatment by the wire feeding method, the Japanese laid-open Patent Publication No. 1996-157935 makes technical improvement to the technique. Before the wire feeding operation, the pre-tapped steel ladle cover is placed on the steel ladle so as to avoid the thorough exposure of liquid steel to the atmosphere.

In order to further improve the production efficiency and reduce fluctuations in the steel making production process, some technicians have also tried to provide calcium treatment for liquid steel in the RH (Ruhrstahl-Heraeus) refining process. The calcium treatment mainly includes the following treatments.

In the Japanese laid-open Patent Publication No. 1999-92819, in the vacuum status, liquid steel is added with calcium metal, calcium alloy and calcium oxide-aluminum oxide alkaline solvent mixture by the blowing method to generate diversified calcic complex inclusions, and also reduce the nitrogen content of liquid steel after vacuum treatment. It shall be pointed out that the complex addition of the above materials is required to reach a relatively satisfactory effect of inclusion control. Further, the actual treatment effect of liquid steel depends on the degree of their mixing and reaction in liquid steel and the status of liquid steel. However, the method has its own disadvantage: liquid steel needs to be added with calcium metal, calcium alloy and calcium oxide-aluminum oxide alkaline solvent mixture, and such mixture is produced at a relatively high cost by complex production processes, etc.

In the Japanese laid-open Patent Publication No. 1998-245621, in the vacuum status, liquid steel is uniformly fed with calcic materials by virtue of the circulation of liquid steel by the wire feeding method, so as to ensure a relatively satisfactory effect of inclusion control. The disadvantage of the method lies in that, the wire feeding method employed for calcium treatment usually causes significant environmental pollution, influences the circulation of liquid steel in vacuum and thus makes it difficult to either ensure the actual treatment effect of liquid steel or get the circulation mode under control, which as a result influence the normal treatment cycle of RH refining, and imposing relatively high requirements on the conditions of wire feeding equipment.

In some papers, in the vacuum status of the laboratory, liquid steel is added with calcium and iron alloy to study the change of inclusions in liquid steel. They point out that, by such calcium treatment method, the total oxygen content of steel is reduced, however, the amount of inclusions is increased and their average size is reduced. Thus, it is applicable only for DI and other special steel types.

Therefore, at present it still needs a method for the calcium treatment of non-oriented electrical steel sheet with relatively low cost, simple production process, convenient and controllable equipment, getting the form and amount of inclusions under control, and without influencing the normal treatment cycle of RH refining.

SUMMARY OF THE INVENTION

The objective of the present invention is to provide a non-oriented electrical steel sheet with excellent magnetic property and its calcium treatment method. The method of the present invention can solve such problems as high production cost, complex production process, influenced normal treatment cycle of RH refining, high requirements on equipment conditions and uncontrolled form and amount of inclusions. The calcium treatment method of the non-oriented electrical steel sheet of the present invention can reduce the production cost, simplify the production process, make the control of equipment convenient and get the form and amount of inclusions under control without influencing the normal treatment cycle of RH refining. The non-oriented electrical steel sheet manufactured by the method of the present invention has an excellent magnetic property.

The present invention provides a calcium treatment method for non-oriented electrical steel, including the RH (Ruhrstahl-Heraeus) refining process, the RH (Ruhrstahl-Heraeus) refining process comprising decarbonization step, aluminum deoxidation step and calcium alloy addition step in sequence, wherein in the calcium alloy addition step, the time for adding calcium alloy satisfies the following conditions:

Time interval between time for Al and time for Ca/ΣTotal time period after time for Al=0.2~0.8, wherein, time interval between time for Al and time for Ca is the time interval between the time point for adding aluminum in said aluminum deoxidation step and the time point for adding calcium alloy in said calcium alloy addition step, and the Σtotal time period after time for Al is the time interval between the time point for adding aluminum in said aluminum deoxidation step and the end point of the RH refining process.

In the method of the present invention, the addition amount of said calcium alloy ranges between 0.5 kg/t steel and 1.2 kg/t steel.

In the method of the present invention, said calcium alloy is added in two or more batches. Preferably said calcium alloy is added in three or more batches, and the addition amount for each batch of said calcium alloy does not exceed 40% of the total addition amount of said calcium alloy.

In the method of the present invention, said calcium alloy is subjected to a passivating treatment.

In the method of the present invention, said calcium alloy has the following chemical composition by weight percentages: Ca 18~27%, Mg 2~6%, Si 20~35%, Al 1~9%, Zr 1~5%, and balance being Fe and unavoidable impurities.

In the method of the present invention, the content of sulfur in liquid steel is maintained to be ≤0.003% before said calcium alloy is added, preferably the content of sulfur in liquid steel is maintained to be ≤0.003% by desulfurization of molten iron or molten steel.

The method of the present invention, further comprises step of silicon deoxidation before said aluminum deoxidation step.

A non-oriented electrical steel manufactured by the method of the present invention, has a chemical composition by weight percentages as below: C≤0.005%, Si 0.2~3.4%, Mn 0.2~1.0%, P≤0.2%, S≤0.003%, Al 0.2%~1.2%, N≤0.005%, O≤0.005%, and balance being Fe and unavoidable impurities. The non-oriented electrical steel further comprises Ca of ≥0.0005%.

The method of the present invention has solved such problems as high production cost, complex production process, influenced normal treatment cycle of RH refining, high requirements on equipment conditions and uncontrolled form and amount of inclusions. The calcium treatment method of the non-oriented electrical steel sheet of the present invention can reduce the production cost, simplify the production process, make the control of equipment convenient and get the form and amount of inclusions under control without influencing the normal treatment cycle of RH refining. The non-oriented electrical steel manufactured by the method of the present invention has an excellent magnetic property.

DETAILED DESCRIPTION OF THE INVENTION

Next, the method of the present invention will be further described in conjunction with the attached figures and examples, but the present invention is not limited to these examples herein.

The steel making process of the non-oriented electrical steel comprises converter blowing, RH refining and continuous casting process.

Figure 1:
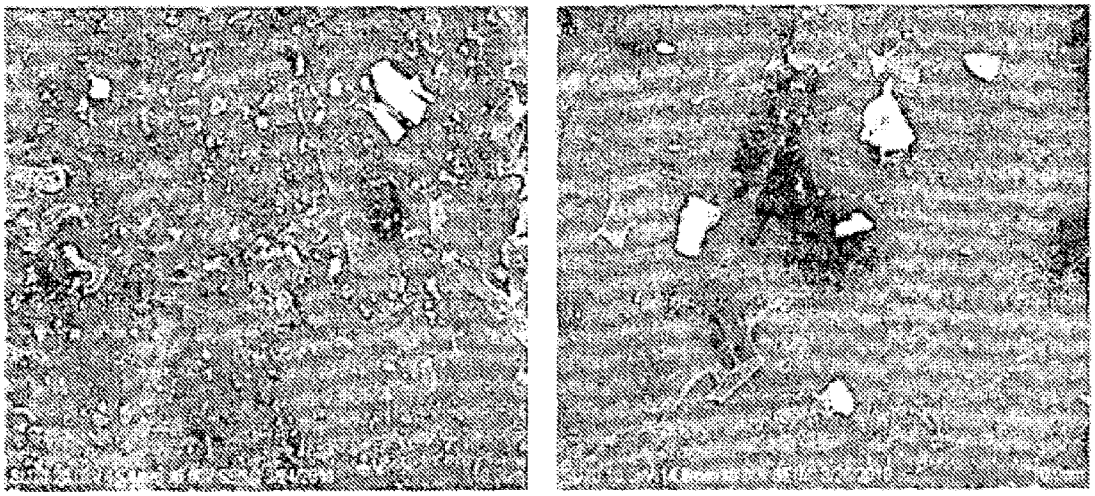
FIG. 1 provides the diagram of inclusion control effect of the finished steel products in the ordinary furnace number (without being added with calcium alloy) and in the calcium treatment furnace number of the present invention (added with calcium alloy).

The RH refining process of the present invention comprises decarbonization step, aluminum deoxidation step and calcium alloy addition step in sequence. As shown in FIG. 1, calcium alloy is added in a specific period of RH refining in the furnace number of the present invention, and the inclusions contained in the finished steel products thus manufactured are large in size and low in amount, so the steel thus manufactured has a high purity and the finished steel products thus manufactured have excellent electromagnetic performance. In the ordinary furnace number (without being added with calcium alloy), the inclusions contained in the finished steel products thus manufactured are small in size and high in amount, so the steel thus manufactured has a low purity and the finished steel products thus manufactured can not be guaranteed of excellent electromagnetic performance.

In the present invention, the RH refining process comprises decarbonization step, aluminum deoxidation step and calcium alloy addition step in sequence, where in the calcium alloy addition step, the time for adding calcium alloy satisfies the following conditions:

Time interval between time for Al and time for Ca/ΣTotal time period after time for Al=0.2~0.8, wherein, the time interval between time for Al and time for Ca is the time interval between the time point for adding aluminum in said aluminum deoxidation step and the time point for adding calcium alloy in said calcium alloy addition step, and the Σtotal time period after time for Al is the time interval between the time point for adding aluminum in said aluminum deoxidation step and the end point of the RH refining process.

The calcium treatment method of the present invention adds calcium alloy in a specific period of RH refining so as to get the form and amount of inclusions under control, and in the present method, the production cost of calcium alloy is low, the production process of calcium alloy is simple, and the addition modes of calcium alloy do not influence the normal treatment cycle of RH refining, and the equipment are convenient for operation and controllable.

Figure 2:
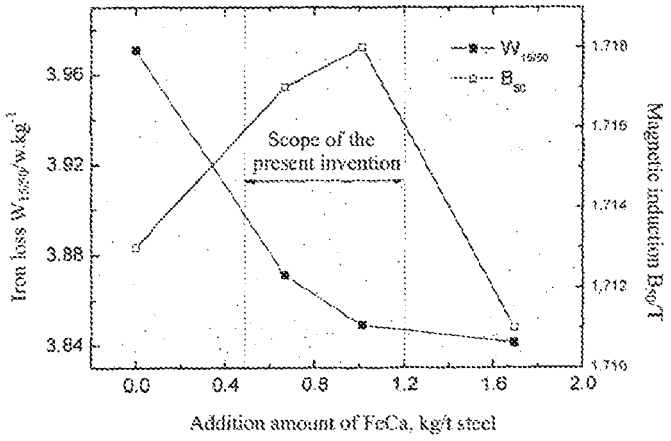
FIG. 2 shows the effects of the addition amount of calcium alloy on the iron loss and magnetic induction of finished steel products.

On the other hand, the effective calcium concentration of liquid steel is an important factor determining the sufficient modification of inclusions. In order to ensure a better calcium treatment effect, the present invention further puts forward its requirements on the addition amount of calcium alloy. FIG. 2 shows the effects of the addition amount of calcium alloy on the iron loss and magnetic induction of the finished steel products. Iron loss refers to the electric energy loss of the silicon steel material under a specific magnetic field intensity and current intensity and at a certain frequency. Magnetic induction refers to the magnetic flux density, which, usually represented by the symbol B, is a fundamental physical quantity employed to describe the intensity and direction of a magnetic field. In physics, the intensity of a magnetic field is represented by magnetic induction intensity (also called magnetic flux density), i.e., a high magnetic induction intensity denotes a strong magnetic induction while a low magnetic induction intensity denotes a weak magnetic induction. The unit of magnetic flux density is Tesla, i.e., T for short. As shown in FIG. 2, when the addition amount of calcium alloy ranges between 0.5 kg/t steel and 1.2 kg/t steel, the finished steel products have a relatively low iron loss and high magnetic induction, and thus have an excellent magnetic property. Thus, in order to ensure the electromagnetic performance of the finished steel products, the addition amount of calcium alloy is set between 0.5 kg/t steel and 1.2 kg/t steel. The calcium alloy is added in two or more batches. Preferably the calcium alloy is added in three or more batches, and the addition amount for each batch of said calcium alloy does not exceed 40% of the total addition amount of said calcium alloy.

In order to increase the retention time of calcium in liquid steel, facilitate the sufficient reaction between calcium and liquid steel and achieve a satisfactory effect of inclusion improvement, the calcium alloy is subjected to a passivating treatment, which means to appropriately increase the surface oxide layer of calcium alloy to reduce its reaction rate.

Besides, the chemical ingredients of calcium alloy are limited. The differences from previous tests lie in that in the test calcium alloy is used to significantly reduce aluminum content and silicon content is appropriately increased so as to increase the melting point of calcium alloy; calcium content is adjusted to control the degree of intense reaction between calcium and liquid steel, and Mg, Zr and other elements are appropriately added to increase the solubility of calcium in liquid steel and increase its yield. In the present invention, the calcium alloy has the following chemical composition by weight percentages: Ca 18~27%, Mg 2~6%, Si 20~35%, Al 1~9%, Zr 1~5%, and balance being Fe and unavoidable impurities.

As found by the present inventor after test, if aluminum deoxidation is directly employed, small inclusions will be generated. The viscosity of liquid steel will increase even if silicon alloy is added after that, so it will be difficult for aluminum oxide inclusions to float upward and to be eliminated, and the calcium treatment has a poor effect on silicon oxide modification. If silicon deoxidation is adopted before aluminum deoxidation, i.e., adopting the two-step deoxidation method (silicon deoxidation and aluminum deoxidation in succession), it will be relatively easier for aluminum oxide inclusions to float upward and to be eliminated. Aluminum has the strong deoxidizing effect, and thus the aluminum oxide inclusions generated by the subsequent deoxidation will be able to be further eliminated by the calcium treatment to generate the calcium aluminate having a low melting point, and the dispersed tiny granular inclusions are inhibited. Thus, in order to better control the form and amount of inclusions, based on the prevent invention, silicon deoxidation is employed before the aluminum deoxidation step, i.e., adopting the two-step deoxidation method (silicon deoxidation and aluminum deoxidation in succession).

Figure 3:
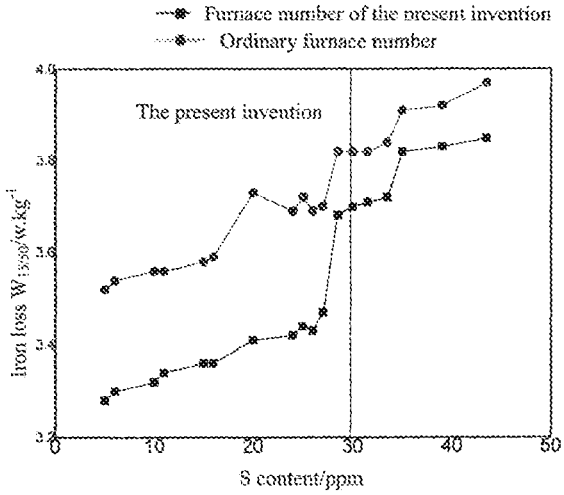
FIG. 3 shows the effects of the sulfur content of liquid steel on the iron loss of finished steel products in the ordinary furnace number and in the calcium treatment furnace number of the present invention.

It has also been found by the present inventor in the industrialized test that, in the calcium treatment, the relatively high content of sulfur in liquid steel will lead to the generation of CaS inclusions in large amount, make it difficult for aluminum oxide inclusions to be fully modified, influence the improvement effect of inclusions contained in the steel and unfavorable to the increase of the electromagnetic performance of the finished steel products. As shown in FIG. 3, when the content of sulfur in liquid steel is >30 ppm (i.e. >0.003%), iron loss is rapidly increased in both the furnace number of the present invention and in the ordinary furnace number, which is unfavorable to the increase of the electromagnetic performance of the finished steel products. Thus, in order to ensure the electromagnetic performance of the finished steel products, the content of sulfur in liquid steel is maintained to be ≤0.003% before the calcium alloy is added; preferably the content of sulfur in liquid steel is maintained to be ≤0.003% by desulfurization of molten iron or molten steel.

The non-oriented electrical steel manufactured by the method of the present invention usually has a chemical composition by weight percentages as below: C≤0.005%, Si 0.2~3.4%, Mn 0.2~1.0%, P≤0.2%, S≤0.003%, Al 0.2%~1.2%, N≤0.005%, O≤0.005%, and balance being Fe and unavoidable impurities. The non-oriented electrical steel further comprises Ca of ≥0.0005%.

Figure 4:
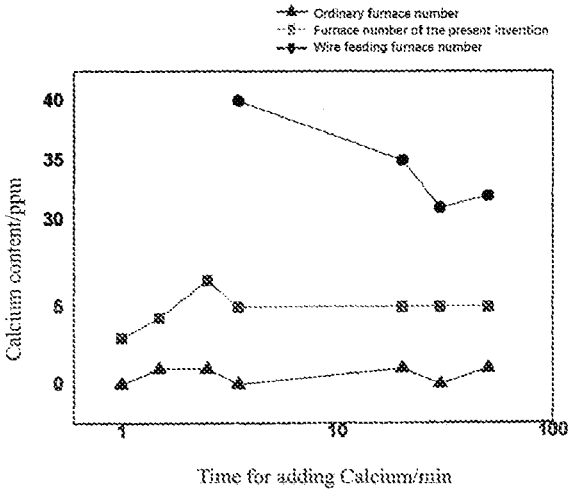
FIG. 4 shows the effects of various addition modes of calcium alloy on calcium content in the wire feeding furnace number, in the calcium treatment furnace number of the present invention and in the ordinary furnace number.

As shown in FIG. 4, the calcium content of the ordinary furnace number is <0.0005%. The calcium content of the wire feeding furnace number is ≥0.0005%, however, when the wire feeding method is employed for calcium treatment, it will cause significant environmental pollution, influence the circulation of liquid steel in vacuum, make it difficult to either ensure the actual treatment effect of liquid steel or put the circulation mode under control, which as a result influence the normal treatment cycle of RH refining; and impose relatively high requirements on the conditions of wire feeding equipment. In the furnace number of the present invention, calcium alloy is added in a specific period of RH refining so that the calcium content of the finished steel products thus manufactured is ≥0.0005%, and in the present method, the addition modes of calcium alloy do not influence the normal treatment cycle of RH refining, and the equipment are convenient for operation and controllable.

In the following section, there are descriptions for the effects of the chemical ingredients of the non-oriented electrical steel of the present invention and the instructions on limiting their contents:

C: Below 0.005%. C is an element which strongly inhibits the growth of grains of the finished products, and may easily deteriorate the magnetic property of the finished strip steel products and lead to severe magnetic aging. Thus, C content must be maintained below 0.005%.

Si: 0.2~3.4%. Si is an element which can effectively increase the resistance of the finished strip steel products. When Si content is lower than 0.2%, it can not effectively reduce the iron loss; when Si content is higher than 3.4%, the magnetic flux density will significantly decline, accompanied by increased hardness and deteriorated processability.

Mn: 0.2~1.0%. Like Si and Al, Mn can also increase the resistance of steel and improve the surface condition of electrical steel. Thus, it's necessary that Mn content is maintained to be above 0.2%. Meanwhile, when Mn content is higher than 1.0%, it will significantly increase the manufacturing cost and reduce the magnetic induction of the finished products.

Al: 0.2~1.2%. Al is an element which can effectively increase the resistance of the finished strip steel products. When Al content is lower than 0.2%, it can not effectively reduce the iron loss, and the magnetic property of the finished products tends to be unstable; when Al content is higher than 1.2%, it will significantly increase the manufacturing cost and reduce the magnetic induction of the finished products.

P: Below 0.2%. Adding a certain amount of P in steel can improve the processability of the steel sheet, however, when P content exceeds 0.2%, the cold-rolling processability of the steel sheet will be deteriorated.

S: Below 0.003%. When S content exceeds 0.003%, it will significantly increase the amount of MnS and other S compounds precipitated, strongly inhibit the growth of grains, deteriorate the condition of iron loss and influence the modification effect of inclusions through calcium treatment.

N: Below 0.005%. When N content exceeds 0.005%, it will significantly increase the amount of AlN and other N compounds precipitated, strongly inhibit the growth of grains and deteriorate the condition of iron loss.

O: Below 0.005%. When O content exceeds 0.005%, it will significantly increase the amount of oxide inclusions, strongly inhibit the growth of grains and deteriorate the condition of iron loss.

EXAMPLES

The following examples are illustrated to explain the implementation of the present invention, and can not be understood to constitute any limitation on the present invention.

Molten iron and scrap steel are proportionally mixed, subjected to 300 ton converter smelting, RH refining for decarbonization and deoxidation, addition of calcium alloy for calcium treatment, and then continuous casting to finally obtain the continuous casting slab #A with 170~250 mm in thickness and 800~1,450 mm in width. See the related process parameters and magnetic property data and chemical ingredients of steel respectively in Table 1 and Table 2.

The lower the iron loss is, the higher the magnetic induction is, and the better the magnetic property of the finished steel products is.

The iron loss and magnetic induction are measured according to the standard JIS-C-2550.

For the continuous casting slab #A, if the magnetic induction is ≥1.76 T and the iron loss is ≤5.7 W/kg, it suggests that the finished steel products have an excellent magnetic property; if the magnetic induction is <1.76 T and the iron loss is >5.7 W/kg, it suggests that the finished steel products have a poor magnetic property.

TABLE 1

| No. | Addition amount | Adding time | Deoxidation mode | Magnetic induction (T) | Iron loss (W/kg) |
|---|---|---|---|---|---|
| Example 1 | 0.53 | 0.24 | Si, Al | 1.764 | 5.43 |
| Example 2 | 1.02 | 0.55 | Si, Al | 1.768 | 5.65 |
| Example 3 | 1.13 | 0.73 | Si, Al | 1.762 | 5.50 |
| Comparative Example 1 | 0.47 | 0.36 | Si, Al | 1.752 | 5.87 |
| Comparative Example 2 | 1.67 | 0.62 | Si, Al | 1.754 | 5.79 |
| Comparative Example 3 | 1.02 | 0.91 | Si, Al | 1.746 | 5.96 |
| Comparative Example 4 | 0.54 | 0.16 | Si, Al | 1.756 | 5.68 |
| Comparative Example 5 | 0.83 | 0.69 | Al, Si | 1.757 | 5.72 |

TABLE 2

| No. | C | Si | Mn | P | S | Ca | Al | O | N |
|---|---|---|---|---|---|---|---|---|---|
| Example 1 | 0.0008 | 0.22 | 0.27 | 0.09 | 0.0022 | 0.0005 | 0.24 | 0.0015 | 0.0013 |
| Example 2 | 0.0029 | 0.26 | 0.26 | 0.08 | 0.0024 | 0.0007 | 0.26 | 0.0028 | 0.0015 |
| Example 3 | 0.0037 | 0.22 | 0.22 | 0.10 | 0.0021 | 0.0006 | 0.25 | 0.0009 | 0.0010 |
| Comparative Example 1 | 0.0031 | 0.21 | 0.22 | 0.09 | 0.0045 | 0.0003 | 0.23 | 0.0021 | 0.0009 |
| Comparative Example 2 | 0.0033 | 0.24 | 0.24 | 0.09 | 0.0038 | 0.0008 | 0.27 | 0.0017 | 0.0009 |
| Comparative Example 3 | 0.0014 | 0.31 | 0.22 | 0.09 | 0.0041 | 0.0017 | 0.23 | 0.0014 | 0.0031 |
| Comparative Example 4 | 0.0042 | 0.27 | 0.22 | 0.09 | 0.0029 | 0.0002 | 0.24 | 0.0012 | 0.0012 |
| Comparative Example 5 | 0.0027 | 0.25 | 0.23 | 0.09 | 0.0038 | 0.0006 | 0.26 | 0.0007 | 0.0018 |

The addition amount refers to the amount of calcium alloy added in the calcium alloy addition step of RH refining.

The adding time refers to the time for adding the calcium alloy in the calcium alloy addition step of RH refining, i.e., time interval between time for Al and time for Ca/Σtotal time period after time for Al.

In the examples 1~3, the addition amount of calcium alloy ranges between 0.5 kg/t steel and 1.2 kg/t steel, and the adding time of calcium alloy ranges between 0.2 and 0.8; the two-step deoxidation method (Si deoxidation and Al deoxidation in succession) is adopted in all cases, with S content ≤0.003%; the finished steel products corresponding to the examples 1~3 have a magnetic induction ≥1.76 T and an iron loss ≤5.7 W/kg, which suggest that they have an excellent magnetic property, with Ca content ≥0.0005%.

In the comparative example 1, the addition amount of calcium alloy is less than 0.5 kg/t steel; in the comparative example 2, the addition amount of calcium alloy is greater than 1.2 kg/t steel; in the comparative example 3, the adding time of calcium alloy is greater than 0.8; in the comparative example 4, the adding time of calcium alloy is less than 0.2; in the comparative example 5, a two-step deoxidation method (Al deoxidation and Si deoxidation in succession) is adopted; in the comparative cases 1, 2, 3 and 5, S content is greater than 0.003%. Thus, the finished steel products corresponding to the comparative examples 1~5 have a magnetic induction <1.76 T and an iron loss >5.7 W/kg, which suggest that they have a poor magnetic property.

Molten iron and scrap steel are proportionally mixed, subjected to 300 ton converter smelting, RH refining for decarbonization and deoxidation, addition of calcium alloy for calcium treatment, and then continuous casting to finally obtain the continuous casting slab #B with 170~250 mm in thickness and 800~1,450 mm in width. See the chemical ingredients and related process parameters and magnetic property data of steel respectively in Table 3 and Table 4.

For the continuous casting slab #B, if the magnetic induction is ≥1.69 T; the iron loss is ≤3.8 W/kg, it suggests that the finished steel products have an excellent magnetic property; if the magnetic induction is <1.69 T; the iron loss is >3.8 W/kg, it suggests that the finished steel products have a poor magnetic property.

TABLE 3

| No. | Addition amount | Adding time | Deoxidation mode | Magnetic induction (T) | Iron loss (W/kg) |
|---|---|---|---|---|---|
| Example 4 | 1.17 | 0.41 | Si, Al | 1.702 | 3.78 |
| Example 5 | 1.17 | 0.80 | Si, Al | 1.694 | 3.65 |
| Example 6 | 0.83 | 0.60 | Si, Al | 1.696 | 3.41 |
| Comparative Example 6 | 0.83 | 0.72 | Si, Al | 1.684 | 3.92 |
| Comparative Example 7 | 0.33 | 0.18 | Al, Si | 1.686 | 3.75 |

TABLE 4

| No. | C | Si | Mn | P | S | Ca | Al | O | N |
|---|---|---|---|---|---|---|---|---|---|
| Example 4 | 0.0028 | 1.25 | 0.69 | 0.002 | 0.0018 | 0.0009 | 0.25 | 0.0010 | 0.0032 |
| Example 5 | 0.0019 | 1.38 | 0.57 | 0.002 | 0.0027 | 0.0008 | 0.26 | 0.0014 | 0.0026 |
| Example 6 | 0.0027 | 1.41 | 0.87 | 0.001 | 0.0022 | 0.0008 | 0.26 | 0.0009 | 0.0009 |
| Comparative Example 6 | 0.0043 | 1.39 | 0.83 | 0.02 | 0.0042 | 0.0002 | 0.37 | 0.0017 | 0.0026 |
| Comparative Example 7 | 0.0036 | 1.41 | 0.59 | 0.02 | 0.0025 | 0.0003 | 0.41 | 0.0014 | 0.0017 |

The addition amount refers to the amount of calcium alloy added in the calcium alloy addition step of RH refining.

The adding time refers to the time for adding calcium alloy in the calcium alloy addition step of RH refining, i.e., time interval between time for Al and time for Ca/Σtotal time period after time for Al.

In the examples 4~6, the addition amount of calcium alloy ranges between 0.5 kg/t steel and 1.2 kg/t steel, and the adding time of calcium alloy ranges between 0.2 and 0.8; the two-step deoxidation method (Si deoxidation and Al deoxidation in succession) is adopted in all cases, with S content ≤0.003%; the finished steel products corresponding to the examples 4~6 have a magnetic induction ≥1.69 T and an iron loss ≤3.8 W/kg, which suggest that they have an excellent magnetic property, with Ca content≥0.0005%.

In the comparative example 6, S content is greater than 0.003%; in the comparative example 7, the addition amount of calcium alloy is lower than 0.5 kg/t steel, and the adding time of calcium alloy is less than 0.2; a two-step deoxidation method (Al deoxidation and Si deoxidation in succession) is adopted. Thus, the finished steel products corresponding to the comparative examples 6~7 have a magnetic induction<1.69 T or an iron loss>3.8 W/kg, which suggest that they have a poor magnetic property.

Table 1~4 indicate that, by controlling the adding time for calcium alloy within the range of 0.2~0.8, controlling the addition amount of calcium alloy within the range of 0.5 kg/t steel~1.2 kg/t steel, adopting the two-step deoxidation method (Si deoxidation and Al deoxidation in succession), and limiting S content to be ≤0.003%, the effect of inclusion control can be stably improved to produce the finished steel products with excellent magnetic property and effectively increase the Ca content of steel.

INDUSTRIAL APPLICABILITY

The method of the present invention has the following advantages: reduced production cost, simplified production process, convenient control of equipment and controllable form and amount of inclusions without influencing the normal treatment cycle of RH refining. The non-oriented electrical steel manufactured by the method of the present invention has an excellent magnetic property, and the present method can be employed for the large-scale production of the non-oriented electrical steel with excellent magnetic property.

The invention claimed is:

1. A calcium treatment method for a non-oriented electrical steel comprising a RH refining process, the RH refining process comprising decarbonization step, aluminum deoxidation step, and calcium alloy addition step in sequence, wherein in the calcium alloy addition step, the time for adding calcium alloy satisfies the following conditions:

time interval between time for Al and time for Ca/ΣTotal time period after time for Al=0.2-0.8, wherein, the time interval between time for Al and time for Ca is the time interval between the time point for adding aluminum in said aluminum deoxidation step and the time point for adding calcium alloy in said calcium alloy addition step, and the Σtotal time period after time for Al is the time interval between the time point for adding aluminum in said aluminum deoxidation step and the end point of the RH refining process; wherein the method results in a non-oriented electrical steel having a chemical composition by weight percentage as follows: C≤0.005%, Si 0.2-3.4%, Mn 0.2-1.0%, P≤0.2%, S≤0.003%, Al 0.2-1.2%, N≤0.005%, O≤0.005%, Ca of 0.0005%-0.0017%, and balance being Fe and unavoidable impurities, and wherein further a magnetic induction of the non-oriented electrical steel is greater than or equal to 1.76 T and an iron loss of the non-oriented electrical steel is less than or equal to 5.7 W/kg.

2. The calcium treatment method of claim 1, wherein the addition amount of said calcium alloy ranges between 0.5 kg/t steel and 1.2 kg/t steel.

3. The calcium treatment method of claim 2, wherein said calcium alloy is added in two or more batches.

4. The calcium treatment method of claim 2, wherein said calcium alloy is added in three or more batches, and the addition amount for each batch of said calcium alloy does not exceed 40% of the total addition amount of said calcium alloy.

5. The calcium treatment method of claim 1, wherein said calcium alloy is subjected to a passivating treatment.

6. The calcium treatment method of claim 1, wherein said calcium alloy has the following chemical composition by weight percentages: Ca 18-27%, Mg 2-6%, Si 20-35%, Al 1-9%, Zr 1-5%, and balance being Fe and unavoidable impurities.

7. The calcium treatment method of claim 1, further comprising a step of silicon deoxidation before said aluminum deoxidation step.

8. The calcium treatment method of claim 1, wherein the content of sulfur in liquid steel is maintained to be ≤0.003% before said calcium alloy is added.

9. The calcium treatment method of claim 8, wherein the content of sulfur in liquid steel is maintained to be ≤0.003% by desulfurization of molten iron or molten steel.

10. A non-oriented electrical steel manufactured by a calcium treatment method comprising a RH refining process, the RH refining process comprising a decarbonization step, aluminum deoxidation step, and calcium alloy addition step in sequence, wherein in the calcium alloy addition step, the time for adding calcium alloy satisfies the following conditions: time interval between time for Al and time for Ca/ΣTotal time period after time for Al=0.2-0.8, wherein, the time interval between time for Al and time for Ca is the time interval between the time point for adding aluminum in the aluminum deoxidation step and the time point for adding calcium alloy in the calcium alloy addition step, and the ΣTotal time period after time for Al is the time interval between the time point for adding aluminum in the aluminum deoxidation step and the end point of the RH refining process, wherein the non-oriented electrical steel has a chemical composition by weight percentage as below: C≤0.005%, Si 0.2-3.4%, Mn 0.2-1.0%, P≤0.2%, S≤0.003%, Al 0.2-1.2%, N≤0.005%, O<0.005%, Ca of 0.0005%-0.0017%, and balance being Fe and unavoidable impurities, and wherein further magnetic induction of the non-oriented electrical steel is greater than or equal to 1.76 T and an iron loss of the non-oriented electrical steel is less than or equal to approximately 5.7 W/kg.

11. The non-oriented electrical steel of claim 10, wherein the addition amount of said calcium alloy ranges between 0.5 kg/t steel and 1.2 kg/t steel.

12. The non-oriented electrical steel of claim 10, wherein said calcium alloy is added in two or more batches.

13. The non-oriented electrical steel of claim 10, wherein said calcium alloy is added in three or more batches, and the addition amount for each batch of said calcium alloy does not exceed 40% of the total addition amount of said calcium alloy.

14. The non-oriented electrical steel of claim 10, wherein said calcium alloy is subjected to a passivating treatment.

15. The non-oriented electrical steel of claim 10, wherein said calcium alloy has the following chemical composition by weight percentages: Ca 18-27%, Mg 2-6%, Si 20-35%, Al 1-9%, Zr 1-5%, and balance being Fe and unavoidable impurities.

16. The non-oriented electrical steel of claim 10, said method further comprising a step of silicon deoxidation before said aluminum deoxidation step.

17. The non-oriented electrical steel of claim 10, wherein the content of sulfur in liquid steel is maintained to be ≤0.003% before said calcium alloy is added.

18. The non-oriented electrical steel of claim 10, wherein the content of sulfur in liquid steel is maintained to be ≤0.003% by desulfurization of molten iron or molten steel.

* * * * *